US007473840B2

(12) United States Patent
Arimoto

(10) Patent No.: US 7,473,840 B2
(45) Date of Patent: Jan. 6, 2009

(54) ELECTRONIC DRUM

(75) Inventor: Keita Arimoto, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 297 days.

(21) Appl. No.: 11/132,913

(22) Filed: May 18, 2005

(65) Prior Publication Data

US 2005/0262991 A1 Dec. 1, 2005

(30) Foreign Application Priority Data

May 25, 2004 (JP) ..... 2004-155354

(51) Int. Cl.
*G10H 7/02* (2006.01)

(52) U.S. Cl. ..... 84/615; 84/628; 84/653; 84/656

(58) Field of Classification Search ..... 84/615, 84/653, 628, 656
See application file for complete search history.

(56) References Cited

U.S. PATENT DOCUMENTS 5,284,080 A * 2/1994 Noguchi et al. ..... 84/604
5,449,964 A 9/1995 Snyder
6,031,176 A * 2/2000 Tanaka ..... 84/735
6,072,112 A 6/2000 Suenaga et al.
6,753,467 B2 6/2004 Tanaka et al.
2005/0150366 A1* 7/2005 Susami ..... 84/735

FOREIGN PATENT DOCUMENTS

JP 06-035450 A 2/1994
JP 09-198040 A 7/1997

* cited by examiner

*Primary Examiner*—Lincoln Donovan
*Assistant Examiner*—David S. Warren
(74) *Attorney, Agent, or Firm*—Morrison & Foerster LLP

(57) ABSTRACT

Respective waveform data on pad strike sounds, rim strike sounds, and rim-shot sounds are stored in a waveform memory, and when a CPU detects a strike detection signal outputted by either of a pad sensor, and a rim sensor, provided in a head unit, a musical tone generating controller reads out waveform data on an strike sound corresponding to the strike detection signal from the waveform memory, thereby generating a musical tone signal corresponding thereto before outputting. Thereafter, when the CPU detects a strike detection signal outputted by the other of the pad sensor, and the rim sensor within a predetermined time, waveform data on a rim-shot sound are read out from the waveform data memory, thereby generating a musical tone signal corresponding thereto before outputting. A sound output unit produces electronic strike sounds corresponding to those musical tone signals, respectively.

8 Claims, 5 Drawing Sheets

ELECTRONIC DRUM

BACKGROUND OF THE INVENTION

1. Field of the Invention

The invention relates to an electronic drum, and more particularly, to an electronic drum comprising a pad having a batter head, and a rim provided around the pad, for detecting a strike respectively, thereby producing electronic sounds differing from each other.

2. Description of the Related Art

An electronic drum as an electronic percussion instrument is a percussion instrument wherein when an electronic drum pad (a batter head) is struck with a stick (drumstick), and so forth, a strike condition, such as stress of a strike, and so forth, is detected by an strike sensor made up of a piezoelectric transducer, and so forth, provided on the back side of the pad, and an electronic tone is produced by an electronic sound generator based on a detection signal from the strike sensor. Further, with a plurality of electronic drums in combination, it is possible to make up an electronic drum set similar to an acoustic drum set made up of acoustic percussion instruments.

Now, a drum as an acoustic percussion instrument is generally structured such that a membrane-like head (batter head) is stretched over an opening edge of a cylindrical shell (body), and the outer edge of the head is pressed with an annular rim (frame) to be secured to the opening edge, and when playing the drum (particularly, in the case of a snare drum), besides an ordinary style of playing for striking the head, there are a style of playing for striking only the rim to produce a hard tone, and a style of playing, called a rim-shot (an open-rim-shot) for striking the head and the rim with a drumstick substantially at the same time, thereby producing unique harmonics of the drum.

A variety of electronic drums with a rim having a dedicated strike sensor, provided around a pad, which is a batter head, have so far been offered, including an electronic drum producing only a rim strike sound differing from a head strike sound, and an electronic drum producing a strike sound corresponding to the rim-shot.

For example, in JP H9-198040A, there has been disclosed an electronic percussion instrument (electronic drum) capable of producing a large variety of tone colors due to relationships in timing between a striking force against a pad, and a striking force or a thrust force against a rim. With the electronic percussion instrument described, it is a precondition for producing a tone color for the open-rim shot playing by striking both the pad and the rim to detect a pad strike within a rim shot standby time (a predetermined time) from detection of a rim strike, as shown in FIG. 6. When the pad strike is detected after the elapse of the predetermined time, a tone color of the pad for a normal playing is produced.

Further, in JP H6-35450A, there has been disclosed an electronic percussion instrument (electronic drum) for causing a musical tone to be produced according to strike detection by a shock sensor of a pad (head), and controlling the musical tone according to an output from a pressure sensor of a rim. With the electronic percussion instrument described, it is a precondition for producing a tone color corresponding to the rim-shot to detect a pad strike within a process time from detection of a rim strike after the rim strike is detected, as shown in FIG. 7.

With the electronic percussion instrument (electronic drum) as disclosed in any of Patent Documents described as above, in order to produce the open-rim shot sound, it has been necessary to make a point of observing a sequence in which the rim is to be first struck followed by a strike of the pad (head), having had no such flexibility as in the case of an acoustic drum capable of producing a rim-shot sound even if the pad is struck slightly ahead, so that those electronic percussion instruments have had a problem in that it is harder to execute the rim-shot playing.

Furthermore, when the rim strike has been first detected, any of those electronic percussion instruments has been simply standing by, or executing the process for the detection until the elapse of the predetermined time or the process time after the detection, having remained in a soundless state producing no sound before determination has been made thereafter on whether or not the pad strike has occurred. Accordingly, there has arisen a problem in that when the rim strike is first detected, a slight delay time always occurs before a musical tone is produced, thereby causing an audience to have a sense of incompatibility at the time of a performance.

SUMMARY OF THE INVENTION

The invention has been developed to solve those problems described in the foregoing, and it is therefore an object of the invention to provide an electronic drum capable of detecting a rim-shot whichever is first struck, a rim or a pad, and producing a musical sound corresponding to a strike input at a point in time immediately whichever first receives the strike input, the rim or the pad.

An electronic drum according to the invention comprises a pad having a pad strike detector, and a rim having a rim strike detector provided on the edge of the pad, for producing electronic sounds differing from each other on the basis of a pad strike detection signal outputted by the pad strike detector, and a rim strike detection signal outputted by the rim strike detector. In order to achieve the object described, the electronic drum further comprises a waveform data memory, and a musical tone generator, described as follows.

The waveform data memory stores waveform data on pad strike sounds generated when only the pad is struck, waveform data on rim strike sounds generated when only the rim is struck, and waveform data on rim-shot sounds generated when both the pad and the rim are struck.

The musical tone generator is configured such that when either of the pad strike detection signal and the rim strike detection signal is generated, sound waveform data on a strike sound corresponding to the either of the strike detection signals are read out from the waveform data memory, thereby generating the musical tone signal corresponding thereto while when the other of the strike detection signals is generated within a predetermined time from generation of the either of the strike detection signals, waveform data on a rim-shot sound are read out from the waveform data memory, thereby generating a musical tone signal corresponding thereto.

Further, the musical tone generator is preferably configured such that when the other of the strike detection signals is generated after the predetermined time from the generation of the either of the strike detection signals, the waveform data corresponding to the other of the strike detection signals are read out from the waveform data memory, thereby generating the musical tone signal corresponding thereto.

Still further, the musical tone generator is preferably configured such that when generating the musical tone signal corresponding to the waveform data on the rim-shot sound, the musical tone signal being produced at that point in time is caused to fade out, and is mixed with the other musical tone signal, thereby generating the musical tone signal corresponding to the waveform data on the rim-shot sound.

In the case where the pad strike detector, and the rim strike detector are capable of detecting a strike strength, respectively, the musical tone generator may be provided with a function of increasing and decreasing respective amplitudes of the musical tone signals generated correspondingly to the respective strike strengths detected by the pad strike detector, and the rim strike detector.

Further, waveform data on the pad strike sounds, waveform data on the rim strike sounds, and waveform data on the rim-shot sounds, stored in the waveform data memory, are preferably waveform data on electronic strike sounds, corresponding to waveform data on pad strike sounds, waveform data on rim strike sounds, and waveform data on rim-shot sounds of a drum as an acoustic percussion instrument, respectively.

The electronic drum according to the present embodiment stores the waveform data on the respective electronic sounds corresponding to the pad strike sounds, the rim strike sounds, and the rim-shot sounds, whichever strike is first detected, a rim strike or a pad strike, waveform data on an electronic sound corresponding to either of the rim strike and the pad strike can be immediately read out at that point in time, thereby generating the musical tone signal corresponding to the waveform data, and only when the other of the rim strike and the pad strike is detected within the predetermined time from the detection of the either thereof, the waveform data on the rim-shot sound are read out at that point in time to thereby generate the musical tone signal corresponding thereto in place of the musical tone signal being generated until then before producing the rim-shot sound. Accordingly, whichever is first struck, the rim or the pad, it is possible to perform the rim-shot playing, so that the rim-shot playing can be easily performed. Furthermore, since whichever is first struck, the rim or the pad, a musical tone corresponding thereto can be immediately produced at that point in time, so that a sense of a natural performance can be gained.

The above and other objects, features and advantages of the invention will be apparent from the following detailed description which is to be read in conjunction with the accompanying drawings.

BRIEF DESCRIPTION OF THE DRAWINGS

FIG. 3 is a flow chart showing a process executed by a CPU after the electronic drum shown in FIG. 1 is turned ON;

DETAILED DESCRIPTION OF THE PREFERRED EMBODIMENTS

Preferred embodiments of the invention are specifically described hereinafter with reference to the accompanying drawings.

Figure 1:
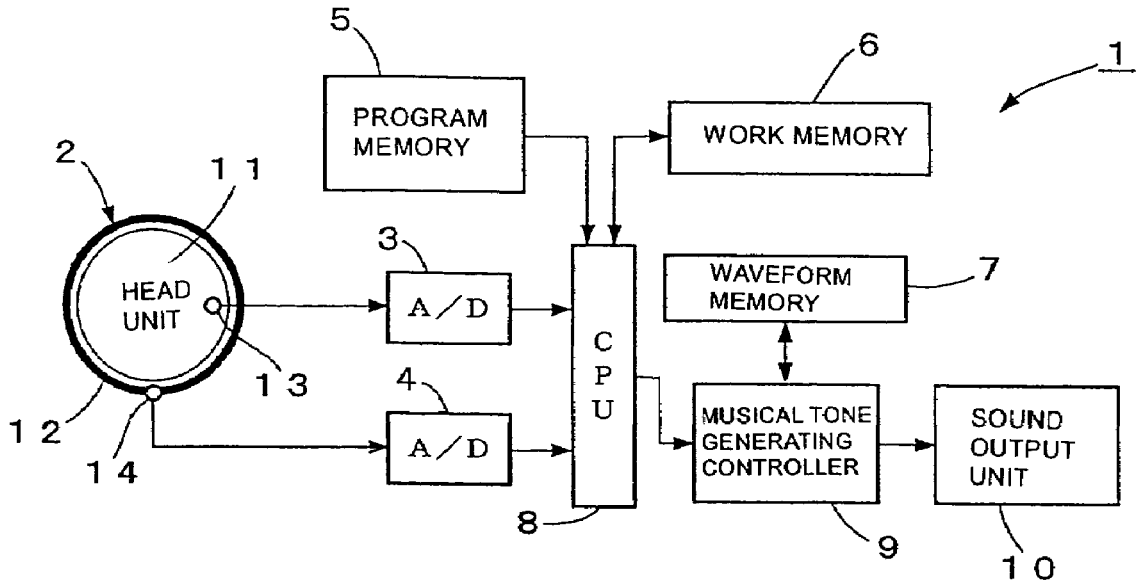
FIG. 1 is a block diagram broadly showing a configuration of one embodiment of an electronic drum according to the invention.

First, a configuration of one embodiment of an electronic drum according to the invention is described with reference to FIG. 1. FIG. 1 is a block diagram broadly showing the configuration of the electronic drum.

The electronic drum 1 is provided with a head unit 2, A/D converters 3, 4, a program memory 5, a work memory 6, a waveform memory 7, a CPU 8, a musical tone generating controller 9, and a sound output unit 10.

The head unit 2 is a metal base body circular in shape, with a rubber cover fitted on the upper face side thereof, structured so as to have a center flat part serving as a pad 11, and a rim 12 provided along the outer peripheral edge of the pad 11. The pad 11 and the rim 12 of the head unit 2 have a pad sensor 13 as a pad strike detector, and a rim sensor 14 as a rim strike detector, respectively, each made up of a piezoelectric transducer, and so on, provided on the inner side of the cover, although not shown in detail in the figure. The respective sensors each function as a trigger signal detector for detecting the timing of a strike by a stick, and varying magnitude of a generated signal voltage, depending on the strike strength.

The A/D converters 3, 4 each are circuits for converting analog signals as strike detection signals outputted from the pad sensor 13, and the rim sensor 14, respectively, into digital signals that can be inputted to the CPU 8. The program memory 5 is a ROM for storing a program that is decodable and executable by the CPU 8, and the work memory 5 is a RAM for temporarily storing various data necessary for executing the program, and data being processed, while the waveform memory 7 is a ROM for storing various electronic strike sound waveform data that will be described in detail later on.

The CPU 8 is a controller for executing multiple-unit-control of operation of the electronic drum 1 as a whole by reading out the program stored in the program memory 5 to thereby execute the same. Further, when a strike by the drumstick is detected from the pad sensor 13 or the rim sensor 14 of the head unit 2, the CPU 8 selects waveform data according to a relationship with a strike detected up to that point in time, and causes the musical tone generating controller 9 to read the waveform data from the waveform memory 7, thereby generating a musical tone signal for an electronic strike sound corresponding to the waveform data.

The musical tone generating controller 9 is controlled by the CPU 8, and reads out the waveform data on the strike sound as designated from the waveform memory 7, thereby generating a musical tone signal for the electronic strike sound according to the waveform data before outputting to the sound output unit 10. The sound output unit 10 is a sound system comprising an amplifier, a speaker, and so forth, for amplifying the musical tone signal delivered from the musical tone generating controller 9, and effecting electroacoustic transduction of the musical tone signal before producing an electronic strike sound similar to an strike sound of an acoustic drum. In this connection, the electronic drum 1 itself need not necessarily be provided with the sound output unit described, but may be instead provided with an output terminal such as a jack, thereby outputting the musical tone signal as generated to a sound output unit externally provided.

With the present embodiment of the invention, the waveform memory 7 is a waveform data memory for storing waveform data on pad strike sounds generated when only the pad is struck, waveform data on rim strike sounds generated when only the rim is struck, and waveform data on the rim-shot sounds generated when both the pad and the rim are struck.

Further, the CPU 8, and the musical tone generating controller 9 function as a musical tone generator configured such that when either of a pad strike detection signal and a rim strike detection signal is generated, sound waveform data on a strike sound corresponding to the either of the strike detection signals are read out from the waveform data memory and the musical tone signal corresponding thereto is generated while when the other of the strike detection signals is generated within a predetermined time from generation of the either of the strike detection signals, waveform data on a rim-shot sound are read out from the waveform data memory, and a musical tone signal corresponding thereto is generated.

The waveform memory 7, and the musical tone generating controller 9 make up the so-called tone generating circuit, and in description given hereinafter, a functional portion of the waveform memory 7 in combination with the musical tone generating controller 9 is also referred to merely as a tone generator.

Next, there will be described in detail hereinafter electronic strike sound waveform data stored by the waveform memory. First, the electronic strike sound waveform data according to the present embodiment are specifically digital data in which amplitude values of waveforms of electronic strike sound signals, at respective points in time, are sequentially stored. The electronic strike sound waveform data include the waveforms for the pad strike sounds generated when only the pad is struck, the waveforms for the rim strike sounds generated when only the rim is struck, and the waveforms for the rim-shot sounds (the so-called open-rim-shot sounds) generated when the pad and the rim are simultaneously struck, the data on the respective waveforms being stored in the waveform memory 7.

Figure 2:
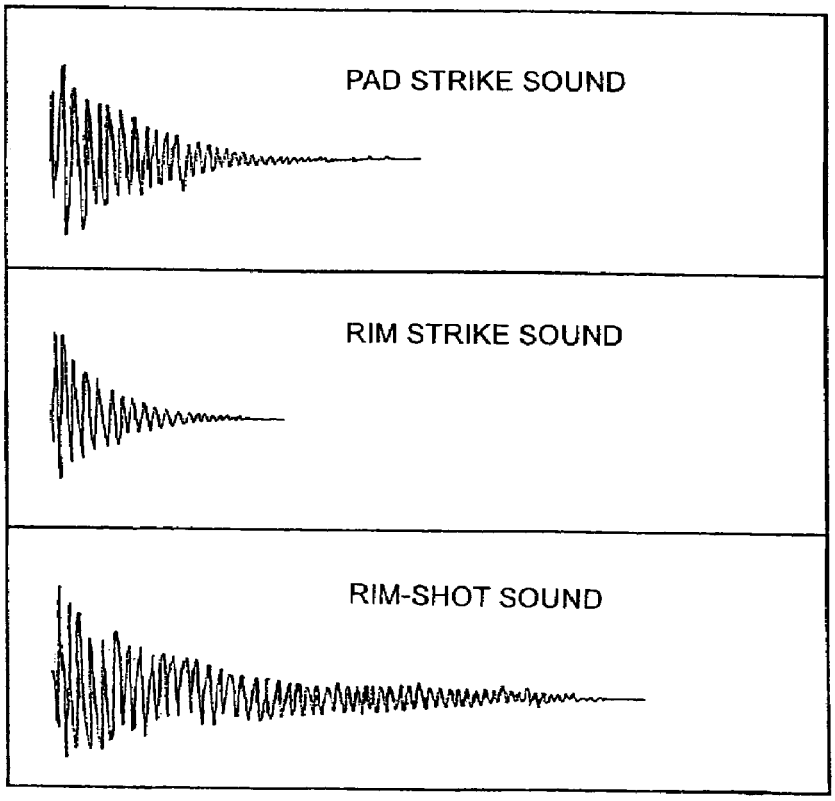
FIG. 2 is a waveform chart showing respective waveforms of a pad strike sound, a rim strike sound, and a rim-shot sound, stored by a waveform memory of the electronic drum, by way of example.

FIG. 2 is a waveform chart showing respective waveforms of a pad strike sound, a rim strike sound, and a rim-shot sound by way of example. As shown in the figure, the respective sound waveforms differ from each other in waveform shape determining a tone color of a strike sound, and in time length (called as sustain time) from immediately after a strike until sound attenuation after gradual decrease in amplitude value, and the waveform of the rim strike sound is shorter in sustain time than the waveform of an ordinary pad strike sound, producing a hard and clear musical sound. Further, the waveform of the rim-shot sound is the longest in sustain time, producing stretched harmonics characteristic of the drum.

Incidentally, the waveform data on the respective strike sounds may be artificially synthesized data, however, use is preferably made of waveform data captured as digital data obtained by sampling acoustic waveforms of the actual strike sounds of acoustic percussion instruments, such as a snare drum, and so forth, from the standpoint of presenting a realistic performance.

Now, operation of the electronic drum according to the present embodiment will be described hereinafter. When either of the pad and the rim is struck with the stick, the electronic strike sound waveform data corresponding thereto are immediately selected, and a musical tone signal for an electronic strike sound in magnitude corresponding to a strike strength is generated, thereby starting to produce a musical tone, and concurrently starting to count an elapsed time after a strike of the either of the pad and the rim. In the case where the other of the pad and the rim is struck before the elapse of a predetermined time, it is determined that the rim-shot holds, thereby producing a rim-shot sound, and when the other thereof is struck after the elapse of the predetermined time, an electronic strike sound corresponding to a strike of the other (either the pad or the rim) is produced.

Figure 3:
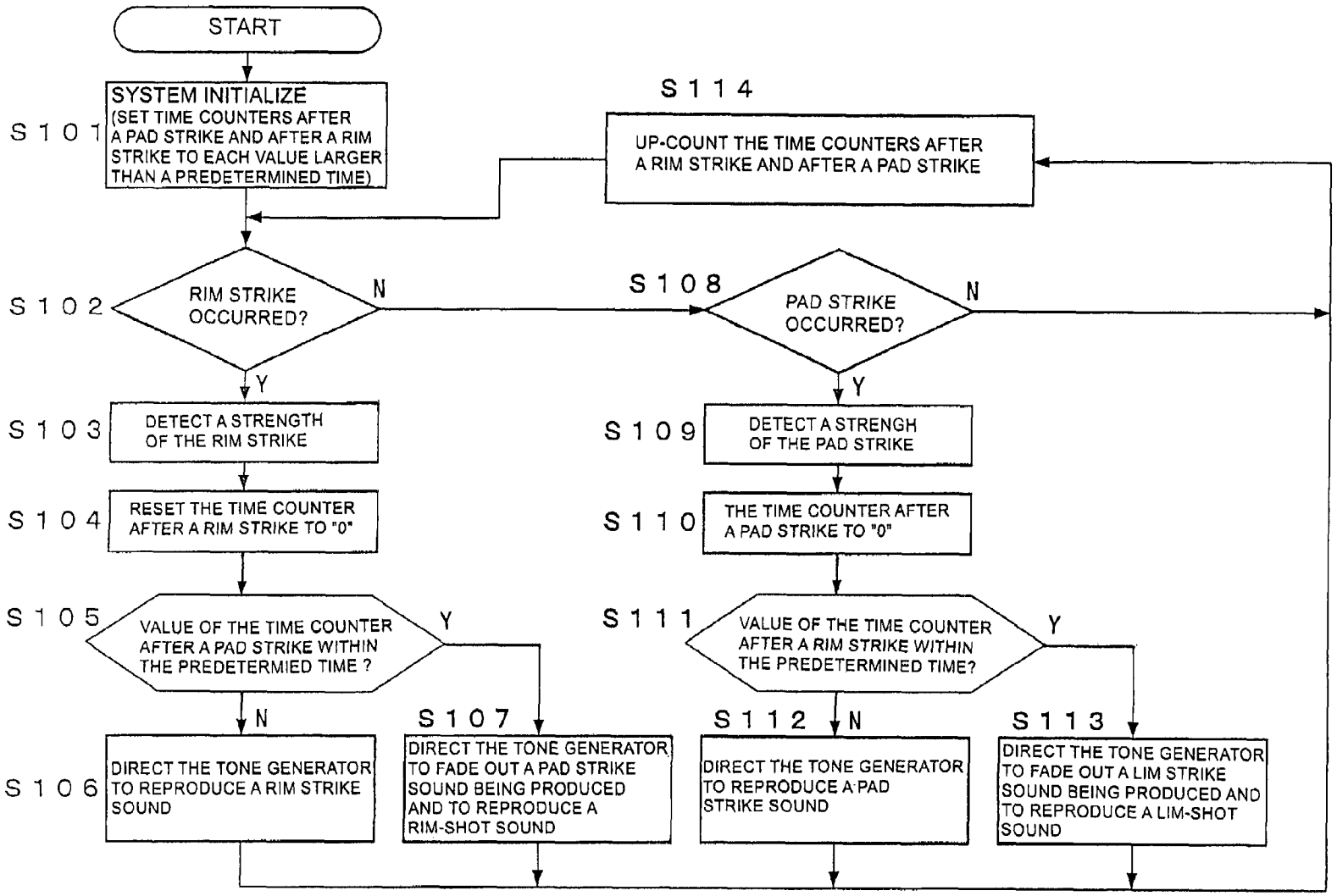

Such a sound-producing process of the electronic drum according to the present embodiment, as described above, will be described in detail with reference to a flow chart in FIG. 3. FIG. 3 is the flow chart showing the process executed by the CPU 8 after the electronic drum 1 shown in FIG. 1 is turned ON. The process shown in the flow chart indicates a process procedure by which the CPU 8 executes the process according to a program stored in the program memory 5. In the flow chart, respective steps of the process are described as S in abbreviation.

With the electronic drum 1 shown in FIG. 1, when the CPU 8 starts the process shown in the flow chart of FIG. 3, a system of the electronic drum is initialized in a step 101. At this point in time, respective units are initialized, and various parameters in the work memory 6 are caused to store initial values. As part of the parameters, both a time counter after a pad strike, and a time counter after a rim strike are set to a value larger than the predetermined time, respectively. As a result of such initialization as above, even if a first strike after the activation of the system is against either of the pad and the rim, a rim-shot sound will not be produced at that point in time because either of the two time counters described is set to the value larger than the predetermined time, producing either a pad strike sound or a rim strike sound. This will be described in detail later on.

Next, the process proceeds to a step 102 to determine whether or not a rim strike has occurred. More specifically, checking is made on whether or not there exists a rim strike detection signal delivered from the rim sensor 14 via the A/D converter 4 (whether or not the value is not less than the predetermined value). As there will be described later a process step taken when it is determined that no rim strike has occurred, there is described herein a process step taken when it is determined that the rim strike has occurred. Then, the process proceeds to a step 103 where a strength of rim strike is detected on the basis of a value of the rim strike detection signal from the rim sensor 14, and is stored in the work memory 6.

Next, in a step 104, the time counter after the rim strike is reset to "0". Then, counting of elapsed times from a rim strike next time, and onwards is executed by up-counting of the time counter after the rim strike in a step 114 within a process loop.

Next, in a step 105, determination is made on whether or not a value of the time counter after the pad strike is within the predetermined time in order to determine whether or not the rim-shot holds due to the rim strike occurring this time. More specifically, the time counter after the pad strike also is configured so as to be reset to "0" immediately after detection of a pad strike (in a step 110 to be described later), counting an elapsed time from that point in time (the step 114), so that by comparing the contents of the time counter after the pad strike with the predetermined time as preset in the step 105, it becomes possible to determine whether or not the rim strike detected in the step 102 has been executed within the predetermined time from the pad strike executed the last time.

At this point in time, if the value of the time counter after the pad strike is found within the predetermined time, it is assumed that the rim 12 is struck before the elapse of the predetermined time from a time when the pad 11 is struck, and the time counter after the pad strike is reset in the step 110 described later, whereupon the process proceeds to a rim-shot process in a step 107 to be described later. Otherwise, assuming that the rim 12 alone is struck, the CPU 8 directs the tone generator to reproduce a rim strike sound in a step 106.

The process in the step 106 is a process for giving a directive to the musical tone generating controller 9 to generate a musical tone signal by reading waveform data on the rim strike sounds from the start thereof out of the waveform memory 7, thereby outputting the musical tone signal to the sound output unit 10.

In this case, even when the rim strike occurring this time is the first strike, the rim-shot does not hold because as a result of the process for the initialization in the step 101, the time counter after the pad strike is set to the value larger than the predetermined time, so that the rim strike sound alone can be produced.

According to the process described, in the case where a rim strike is first detected in a performance by the rim-shot playing, and even in the case where a rim strike alone is singly or continuously carried out with the elapse of not less than the predetermined time after a pad strike, a rim strike sound can be immediately produced, so that there is no delay time between a strike and a produced sound, thereby enabling a sense of a natural performance to be obtained. Furthermore, when producing the rim strike sound, by increasing and decreasing the amplitude of a musical tone signal generated correspondingly to the strike strength as detected and stored in the step 103, an electronic strike sound to be produced can be provided with a stress.

Figure 4:
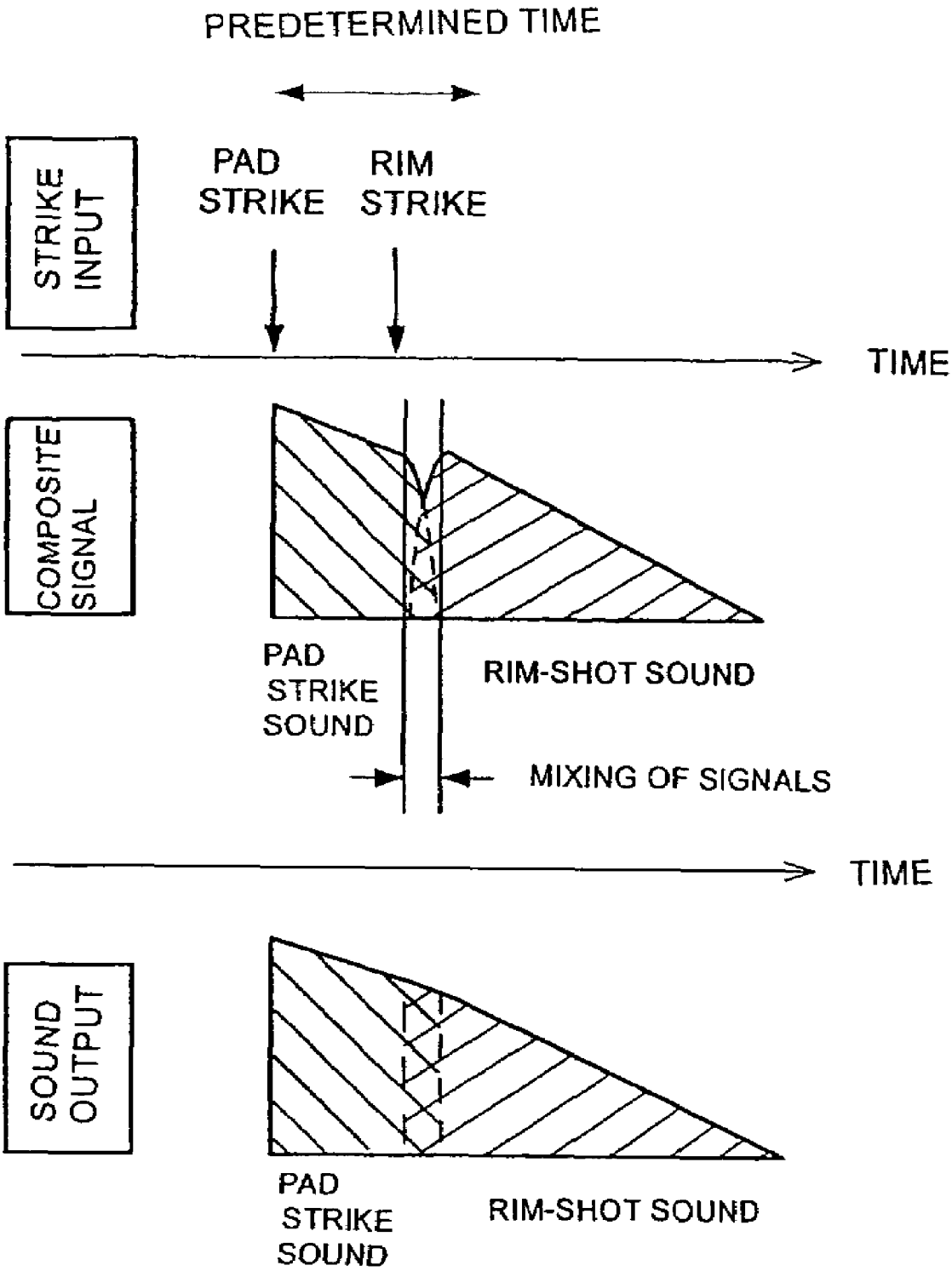
FIG. 4 is a schematic representation illustrating a relationship among a strike input, signal synthesis, and produced sound output when a pad and a rim are struck in sequence in the case of the electronic drum according to the invention.

Meanwhile, when the process proceeds to the rim-shot process in the step 107, the CPU 8 directs the tone generator to fade out a pad strike sound being produced, thereby reproducing a rim-shot sound. In such a process, as shown in FIG. 4, the CPU 8 directs the musical tone generating controller 9 to rapidly decrease an amplitude value of a musical tone signal for the pad strike sound being produced up to then, and read the waveform data on the rim strike sounds from the start thereof from the waveform memory 7 so as to produce a musical tone signal for the rim-shot sound, thereby causing both the musical tone signals to undergo mixed synthesis.

By so doing, even at the time of changing over between respective waveform data, a musical tone undergoes a natural change, thereby enabling a performance without giving a sense of incompatibility to be implemented. Waveforms shown in FIG. 4 indicate envelope waveforms representing changes in magnitude of amplitude values. Further, even when producing the rim-shot sound in this way, the electronic strike sound can be provided with a stress correspondingly to the strike strength as detected and stored in the step 103.

After the tone generator is directed to reproduce the rim strike sound, or the rim-shot sound in the step 106 or the step 107, respectively, up-counting at both the time counter after the rim strike, and the time counter after the pad strike is executed in the step 114, thereby counting elapsed times from the respective strikes occurring the last time, and thereafter, the process reverts to the determination on whether or not the rim strike has occurred in the step 102, repeating the steps in the loop for this sound-produce process.

Next, there will be described hereinafter a process step taken when it is determined in the step 102 that no rim strike has occurred. In this case, the process proceeds to a step 108 to determine whether or not a pad strike has occurred. More specifically, checking is made on whether or not there exists a pad strike detection signal delivered from the pad sensor 13 via the A/D converter 3 (whether or not the value is not less than the predetermined value). When it is determined that no pad strike has occurred, the process reverts to the step 102 after the up-counting of both the time counter after the rim strike, and the time counter after the pad strike is executed in the step 114, and produces no musical tone before detection of a strike against the rim 12 or the pad 11, repeating the two determinations, and counting of elapsed time, in the loop made up of the steps 102, 108, and 114.

When it is determined in the step 108 that the pad strike has occurred, the process is executed as described in steps from S109 and onwards. The process in the steps 109 to 113 is similar to that in the steps 102 to 107 for the case where the rim strike has occurred.

First, in the step 109, a strength of the pad strike is detected, and is stored in the work memory 6, and the time counter after the pad strike is reset to "0" in the step 110, after which, in the step 111, a value of the time counter after the rim strike is compared with the predetermined time as preset, whereupon if the value is not within the predetermined time, the process proceeds to the step 112 where the CPU 8 directs the tone generator to reproduce a pad strike sound while if the value is within the predetermined time, it is determined that the rim-shot holds, and the process proceeds to the step 113 where the CPU 8 directs the electronic sound generator to fade out a rim strike sound being produced, and to reproduce a rim-shot sound.

The process in the step 112 is a process for giving a directive to the musical tone generating controller 9 to generate a musical tone signal by reading waveform data on the pad strike sounds from the start thereof out of the waveform memory 7, thereby outputting the musical tone signal to the sound output unit 10.

In this case, even when the pad strike occurring this time is the first strike, the rim-shot does not hold because as a result of the process for the initialization in the step 101, the time counter after the rim strike is set to the value larger than the predetermined time, so that the pad strike sound alone can be produced.

Accordingly, in the case where a pad strike is first detected in a performance by the rim-shot playing, and even in the case where a pad strike alone is singly or continuously carried out after the elapse of not less than the predetermined time after a rim strike, a pad strike sound can be immediately produced, so that there is no delay time between a strike and a produced sound, thereby enabling a sense of a natural performance to be obtained. Furthermore, when producing the pad strike sound by increasing and decreasing the amplitude of a musical tone signal generated correspondingly to the strike strength as detected and stored in the step 109, an electronic strike sound to be produced can be provided with a stress.

Figure 5:
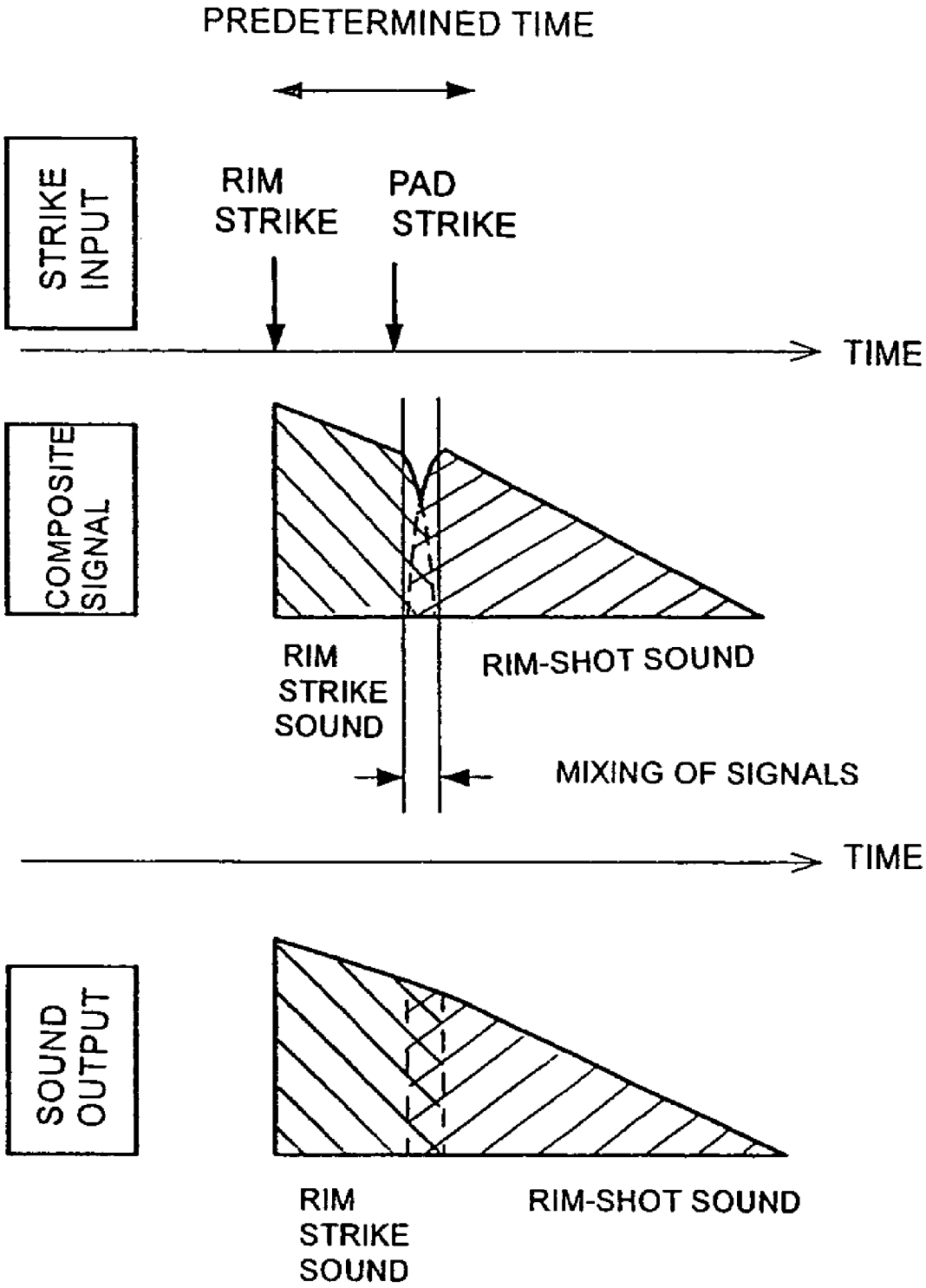
FIG. 5 is a schematic representation illustrating a relationship among a strike input, signal synthesis, and produced sound output when the rim and the pad are struck in sequence in the case of the electronic drum according to the invention.
Figure 6:
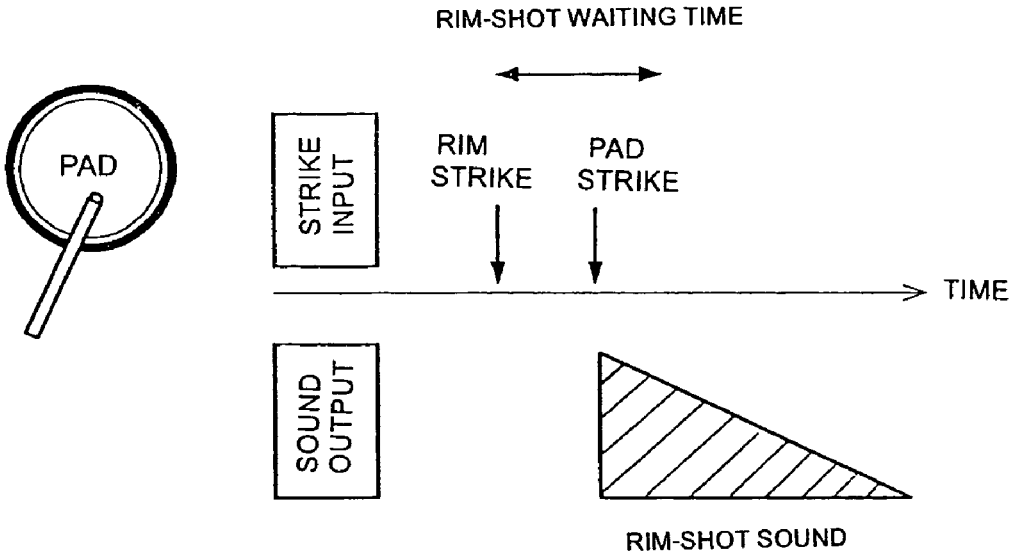
FIG. 6 PRIOR ART
FIG. 6 is a schematic representation illustrating an example of controlling a produced sound in the case of a conventional electronic drum.
Figure 7:
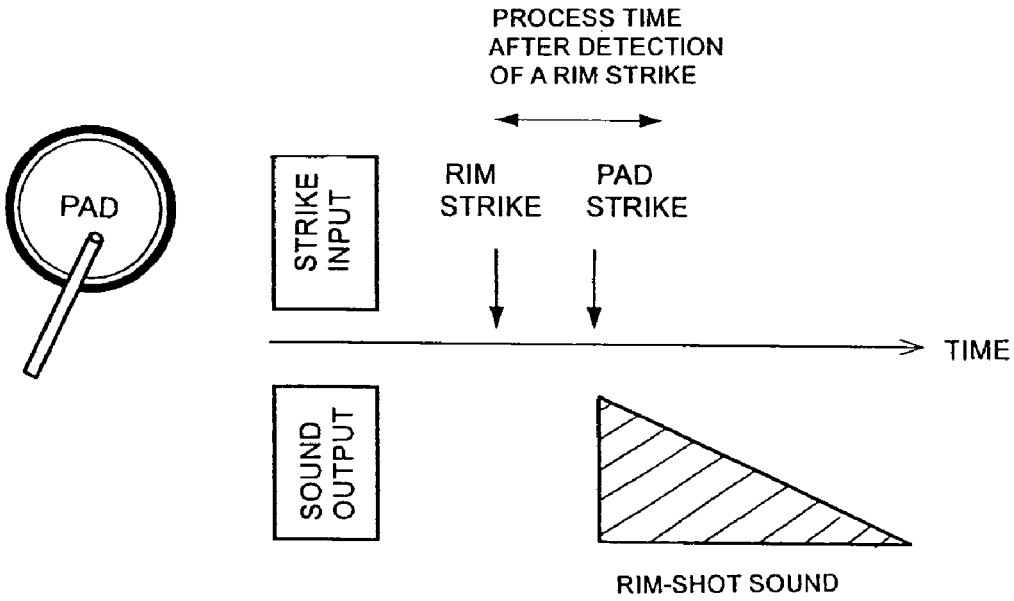
FIG. 7 PRIOR ART
FIG. 7 is a schematic representation illustrating another example of controlling a produced sound in the case of a conventional electronic drum.

Meanwhile, when the process proceeds to the rim-shot process in the step 113, the CPU 8 directs the musical tone generating controller 9 (tone generator) to rapidly decrease an amplitude value of a musical tone signal for the rim strike sound being produced up to then, and read the waveform data on the rim strike sounds from the start thereof from the waveform memory 7 so as to produce a musical tone signal for the rim-shot sound, thereby causing both the musical tone signals to undergo mixed synthesis, as shown in FIG. 5.

By so doing, even at the time of changing over between respective waveform data, a musical tone undergoes a natural change, thereby enabling a performance without giving a sense of incompatibility to be implemented. Further, waveforms shown in FIG. 5 indicate envelope waveforms representing changes in magnitude of amplitude values. Further, even when producing the rim-shot sound in this way, the electronic strike sound can be provided with a stress so as to correspond to the strike strength as detected and stored in the step 109.

After the electronic sound generator is directed to reproduce the pad strike sound, or the rim-shot sound in the step 112 or the step 113, respectively, up-counting of both the time counter after the rim strike, and the time counter after the pad strike is executed in the step 114, and thereafter, the process reverts to the step 102, repeating the process steps as described in the foregoing.

As a result of the sound-produce process described, the electronic drum according to the present embodiment is capable of producing a rim-shot sound whichever is first struck, the rim or the pad, enabling therefore the rim-shot playing to be easily performed. Furthermore, whichever is first struck, the rim or the pad, a musical tone corresponding thereto can be immediately produced at that point in time, so that a sense of a natural performance can be gained.

With the process according to the present embodiment, shown in FIG. 3, however, the time counter after the rim strike is reset every time a rim strike occurs, and the time counter after the pad strike is reset every time a pad strike occurs, so that if a rim-shot sound is produced as a result of a strike to both the rim and the pad within the predetermined time, and subsequently, either of the rim and the pad is struck again within the predetermined time, this will cause a rim-shot sound to be again produced.

Accordingly, once a rim-shot sound is produced, both the time counters may be set to values larger than the predetermined time, respectively, and neither of both the time counters may not be reset before the elapse of the predetermined time even if a rim strike or a pad strike occurs. By so doing, even if the rim, or the pad is struck again within the predetermined time after a rim-shot sound is once produced, no rim-shot sound is produced, producing instead a strike sound of either the rim that has been struck or the pad that has been struck.

Further, with the present embodiment described hereinbefore, when producing a rim-shot sound, the mixed synthesis of the musical tone signals is implemented by fading in the musical tone signal for the rim-shot sound while fading out the musical tone signal for either the rim strike sound or the pad strike sound, being produced until then, however, instead of the above, the rim-shot sound may be produced by changing over between the musical tone signals in a natural way by effecting only fade-out without effecting fade-in, or by effecting neither particular fade-out nor fade-in.

Still further, with the present embodiment described, by increasing and decreasing the amplitude of a musical tone signal generated correspondingly to a strike strength, the musical tone signal is outputted, however, instead of the above, the musical tone signal may be outputted by increasing and decreasing the amplitude of the musical tone signal according to a parameter other than the strike strength, or the musical tone signal may be outputted always at the same amplitude upon detection of a strike without increasing and decreasing the amplitude of the musical tone signal as above.

Yet further, the waveform data on the respective strike sounds of the electronic drum are not limited to the waveform data captured by sampling the waveforms for the actual respective strike sounds of a drum as an acoustic percussion instrument, but may be prepared by artificial synthesis or may be prepared by working on the waveform data captured by sampling the waveforms for the actual respective strike sounds of an acoustic drum.

The invention can be applied to an electronic drum used in an electronic drum set, and so forth, enabling a rim-shot sound to be produced if the rim and the pad are stuck within the predetermined time regardless of striking sequence in which the rim and the pad are struck.

In addition, immediately after occurrence of whichever strike, a rim strike or a pad strike, a strike sound thereof can be produced, so that it is possible to perform the rim-shot playing with ease, and in a natural way. Accordingly, with the invention, an electronic drum can enhance utility thereof.

What is claimed is:

1. An electronic drum comprising a pad having a pad strike detector, and a rim having a rim strike detector provided on the edge of the pad, for producing electronic sounds differing from each other on the basis of a pad strike detection signal outputted by the pad strike detector, and a rim strike detection signal outputted by the rim strike detector, said electronic drum further comprising:

a waveform data memory storing waveform data on pad strike sounds generated when only the pad is struck, waveform data on rim strike sounds generated when only the rim is struck, and waveform data on rim-shot sounds generated when both the pad and the rim are struck; and a musical tone generator reading out sound waveform data on an strike sound corresponding to the pad of the strike detection signals from the waveform data memory, thereby generating the musical tone signal corresponding thereto when the pad strike detection signal is generated, while reading out waveform data on a rim-shot sound from the waveform data memory, thereby generating a musical tone signal corresponding thereto when the rim the strike detection signals is generated within a predetermined time from generation the pad the strike detection signals.

2. An electronic drum according to claim 1, wherein the musical tone generator reads out the waveform data corresponding to the other of the strike detection signals from the waveform data memory, thereby generating the musical tone signal corresponding thereto when the other of the strike detection signals is generated after the predetermined time from the generation of the either of the strike detection signals.

3. An electronic drum according to claim 1, wherein the musical tone generator causes the musical tone signal being produced at that point in time to fade out, and mix it with the other musical tone signal, thereby generating the musical tone signal corresponding to the waveform data on the rim-shot sound, when generating the musical tone signal corresponding to the waveform data on the rim-shot sound.

4. An electronic drum according to claim 2, wherein the musical tone generator causes the musical tone signal being produced at that point in time to fade out, and mix it with the other musical tone signal, thereby generating the musical tone signal corresponding to the waveform data on the rim-shot sound, when generating the musical tone signal corresponding to the waveform data on the rim-shot sound.

5. An electronic drum according to claim 1, wherein the pad strike detector, and the rim strike detector are capable of detecting a strike strength, respectively, and the musical tone generator is provided with a function of increasing and decreasing respective amplitudes of the musical tone signals generated correspondingly to the respective strike strengths detected by the pad strike detector, and the rim strike detector.

6. An electronic drum according to claim 2, wherein the pad strike detector, and the rim strike detector are capable of detecting a strike strength, respectively, and the musical tone generator is provided with a function of increasing and decreasing respective amplitudes of the musical tone signals generated correspondingly to the respective strike strengths detected by the pad strike detector, and the rim strike detector.

7. An electronic drum according to claim 1, wherein waveform data on the pad strike sounds, waveform data on the rim strike sounds, and waveform data on the rim-shot sounds, stored in the waveform data memory, are waveform data on electronic strike sounds, corresponding to waveform data on pad strike sounds, waveform data on rim strike sounds, and waveform data on rim-shot sounds of a drum as an acoustic percussion instrument, respectively.

8. An electronic drum according to claim 2, wherein waveform data on the pad strike sounds, waveform data on the rim strike sounds, and waveform data on the rim-shot sounds, stored in the waveform data memory, are waveform data on electronic strike sounds, corresponding to waveform data on pad strike sounds, waveform data on rim strike sounds, and waveform data on rim-shot sounds of a drum as an acoustic percussion instrument, respectively.

* * * * *